US009315951B1

(12) United States Patent
Penland, Jr. et al.

(10) Patent No.: US 9,315,951 B1
(45) Date of Patent: Apr. 19, 2016

(54) MAT CONSTRUCTION HAVING ENVIRONMENTALLY RESISTANT SKIN

(71) Applicant: Joe Penland, Jr., Beaumont, TX (US)

(72) Inventors: Joe Penland, Jr., Beaumont, TX (US); Rustin Penland, Beaumont, TX (US); Scott Calvert, Beaumont, TX (US); Thomas O'Brien, Wanaka (NZ)

(73) Assignee: Joe Penland, Jr., Beaumont, TX (US)

( * ) Notice: Subject to any disclaimer, the term of this patent is extended or adjusted under 35 U.S.C. 154(b) by 0 days.

(21) Appl. No.: 14/839,900

(22) Filed: Aug. 28, 2015

Related U.S. Application Data

(60) Provisional application No. 62/052,954, filed on Sep. 19, 2014.

(51) Int. Cl.
*E01C 5/14* (2006.01)
*E01C 9/08* (2006.01)

(52) U.S. Cl.
CPC .. *E01C 5/14* (2013.01); *E01C 9/086* (2013.01)

(58) Field of Classification Search
CPC ..... E01C 9/086; E01C 9/08; E01C 5/00; E01C 11/24; E01C 5/14
See application file for complete search history.

(56) References Cited

U.S. PATENT DOCUMENTS 2,836,529 A 5/1958 Morris
4,462,712 A 7/1984 Penland, Sr.
4,629,358 A 12/1986 Springston et al.
4,889,444 A * 12/1989 Pouyer ..... E01C 9/086 404/34
5,020,937 A * 6/1991 Pouyer ..... E01C 9/086 404/35
5,163,776 A * 11/1992 Pouyer ..... E01C 9/086 404/34
5,273,373 A * 12/1993 Pouyer ..... E01C 9/086 404/35
5,342,260 A 8/1994 Markland
5,822,944 A 10/1998 Penland, Sr.
5,888,612 A 3/1999 Needham et al.
6,214,428 B1 * 4/2001 Henderson ..... B27M 3/0046 238/14
6,231,994 B1 5/2001 Totten
6,380,309 B1 4/2002 Parker et al.
6,474,905 B1 11/2002 Smith, Jr. et al.
6,511,257 B1 1/2003 Seaux et al.
6,662,508 B1 12/2003 Else
6,821,623 B2 11/2004 Kvesic
7,404,690 B2 7/2008 Lukasik et al.
7,413,374 B2 8/2008 Rogers et al.
7,427,172 B2 9/2008 Lukasik
7,818,929 B2 10/2010 Fiutak et al.
8,061,929 B2 11/2011 Dagesse
8,088,477 B2 1/2012 Curtis et al.
8,382,393 B1 2/2013 Phillips
8,613,373 B2 12/2013 Holtby et al.
8,784,001 B1 * 7/2014 Phillips ..... E21B 41/0021 404/35

(Continued)

FOREIGN PATENT DOCUMENTS

CA 2 233 776 A1 12/1999
WO 2006/002507 A1 1/2006

*Primary Examiner* — Abigail A Risic
(74) *Attorney, Agent, or Firm* — Winston & Strawn LLP

(57) ABSTRACT

An industrial mat that includes a core construction that provides strength and rigidity to the mat, with the core construction including plural layers or plies of components at least some of which are of wood or engineered wood; and a durable skin that surrounds and encapsulates at least the wood components of the mat or the entire core construction. The skin has a thickness sufficient to provide environmental resistance to the wood components or to the core construction to which it is applied. The skin also provides abrasion resistance to the boards and mat.

17 Claims, 4 Drawing Sheets

(56) References Cited

U.S. PATENT DOCUMENTS

| | | | | |
|---|---|---|---|---|
| 8,906,480 | B2 | 12/2014 | Fiutak et al. | |
| 8,936,073 | B1 * | 1/2015 | Phillips | E04B 5/02 166/75.11 |
| 9,133,598 | B2 | 9/2015 | Hsu | |
| 2002/0110418 | A1 | 8/2002 | Renick | |
| 2004/0037644 | A1 | 2/2004 | Renick | |
| 2004/0253055 | A1 * | 12/2004 | Polivka, Jr. | E01C 9/086 405/43 |
| 2006/0265976 | A1 * | 11/2006 | Fiutak | B27M 3/0053 52/177 |
| 2007/0056228 | A1 | 3/2007 | Penland et al. | |
| 2008/0028703 | A1 | 2/2008 | Brandstrom | |
| 2008/0085154 | A1 * | 4/2008 | Lukasik | E01C 5/18 404/35 |
| 2008/0152861 | A1 | 6/2008 | Barker | |
| 2009/0301004 | A1 | 12/2009 | Dagesse | |
| 2011/0233363 | A1 | 9/2011 | Wold | |
| 2012/0063844 | A1 | 3/2012 | Wold | |
| 2013/0306804 | A1 | 11/2013 | Holtby et al. | |
| 2013/0318896 | A1 * | 12/2013 | Rogers | E01C 9/08 52/223.7 |
| 2014/0193196 | A1 | 7/2014 | Fournier | |
| 2014/0199119 | A1 | 7/2014 | Stasiewich et al. | |
| 2014/0205377 | A1 * | 7/2014 | Hill | E21B 41/00 404/35 |
| 2014/0341649 | A1 | 11/2014 | Bryan et al. | |

* cited by examiner

MAT CONSTRUCTION HAVING ENVIRONMENTALLY RESISTANT SKIN

This application claims the benefit of application No. 62/052,954 filed Sep. 19, 2014, the entire content of which is expressly incorporated herein by reference thereto.

BACKGROUND

The present invention relates to a reusable system for the construction of roadways and equipment support surfaces in areas having poor ground integrity characteristics. More particularly, the present invention relates to a system of durable mats which can be interconnected to form roadways and/or equipment support surfaces. More particularly still, the present invention relates to a reusable system of mats which can be quickly and easily positioned in a single layer to form roadways and/or equipment support surfaces, and which can thereafter be easily removed and stored until needed again.

Mats for this use are generally known in the art and are available from Quality Mat Company, Beaumont, Tex. In remote and unstable environments, a stable roadway (or any roadway) often does not exist, such that temporary roadways are assembled by aligning planks, boards or mats along the desired path. The mats provide temporary structures for various construction projects as well as for use in environmental or disaster cleanup projects. These mats enable trucks and other equipment to drive over, store equipment on, or create campsites on otherwise unstable, soft or moist land or damaged areas by providing a relatively level and stable surface.

While conventional wood mats provide useful service at a reasonable cost, the wood core, which is typically made of white oak, can deteriorate over time due to moisture causing gradual rotting and degradation of the wood material. This causes the mat to be discarded, because unlike some of the other materials that are used on the upper and lower layers of the mat, the core cannot be replaced without essentially making an entirely new mat.

While various mats exist for such uses, there is a need for mats having improved resistance to wood deterioration as well as to abuse of and damage to the mats in order to extend their service lives. The present invention now provides new mat constructions that meet this need.

SUMMARY OF THE INVENTION

The invention relates to an industrial mat comprising a core construction that provides strength and rigidity to the mat, the core construction including plural layers or plies of components at least some of which are wood or engineered wood; and an encapsulation of a durable skin that surrounds and encapsulates at least the wood components or the entire core construction, with the skin having a thickness sufficient to provide environmental resistance to the wood components or core construction to which it is applied and also providing abrasion resistance to the mat.

The mat advantageously includes a core construction comprising a central layer made of a sheet, a plurality of elongated members, a plurality of compartments, or combinations thereof and the entire core construction is provided with the encapsulation; and one or both of an upper layer positioned above the central layer and a lower layer positioned below the central layer, wherein the upper and lower layers are each made of a sheet, a plurality of elongated members, a plurality of compartments, or combinations thereof. The central, upper and lower layers each preferably comprises a plurality of wood or engineered wood boards having a modulus of at least about 1.6 M psi.

The skin generally comprises a thermoplastic, thermosetting or elastomeric material or a mixture thereof and has a thickness of 0.25 to 0.5 inches. Advantageously, the skin comprises a mixture of an elastomeric material and a thermoplastic or thermosetting resin.

In an embodiment where the entire mat is encapsulated by the skin, the skin has upper and lower portions which are configured to conform to and encapsulate the core construction and which have peripheries that are in contact and are joined together to encapsulate and seal the core construction therein. The skin preferably comprises high density polyethylene or an elastomeric material, and the core construction comprises plural layers that include elongated members of wood and preferably engineered wood. The core construction includes a central layer, an upper layer positioned above the central layer or a lower layer positioned below the central layer or both upper and lower layers, wherein each layer includes a plurality of elongated members of wood or engineered wood.

Anther embodiment of the invention relates to an industrial mat comprising a core construction that provides strength and rigidity to the mat, the core construction including plural layers or plies of elongated wood or engineered wood members; and an encapsulation of a durable skin that surrounds and encapsulates each of the elongated wood members. As above, the skin has a thickness sufficient to provide environmental resistance to the elongated wood or engineered wood member to which it is applied and being made of a material that also provides abrasion resistance to the mat.

The skin for each wood component again comprises a thermoplastic, thermosetting or elastomeric material or a mixture thereof and has a thickness of 0.25 to 0.5 inches. A preferred core construction comprises a central layer and an upper layer; a central layer and a lower layer, or a central layer, upper layer and lower layer, and the skin comprises high density polyethylene, an elastomeric material, or a mixture of an elastomeric material and a thermoplastic or thermosetting resin. The skin can be applied as a coating, paint, sheet or layer or other arrangement. When applied as a sheet or layer, the ends of the wood components and overlapping ends of the sheet or layer may be sealed with an adhesive, paint or coating. Preferably, the skin is applied as a coating and the layers of the core construction each include a plurality of wood boards having a modulus of at least about 1.6 M psi±20%

For each embodiment, the core construction is made of materials that provide a load bearing capacity that enables the mat to withstand a load of at least 600 to 800 psi without permanently deforming the core construction. Also, as the elongated wood or engineered wood members are attached to the mat with bolts, the bolt heads and nuts are preferably provided with o-rings or gaskets to prevent moisture from entering into bolt holes into the elongated wood or engineered wood members.

BRIEF DESCRIPTION OF THE DRAWINGS

The appended drawing figures provide additional details of the invention, wherein.

DETAILED DESCRIPTION OF THE INVENTION

Figure 1:
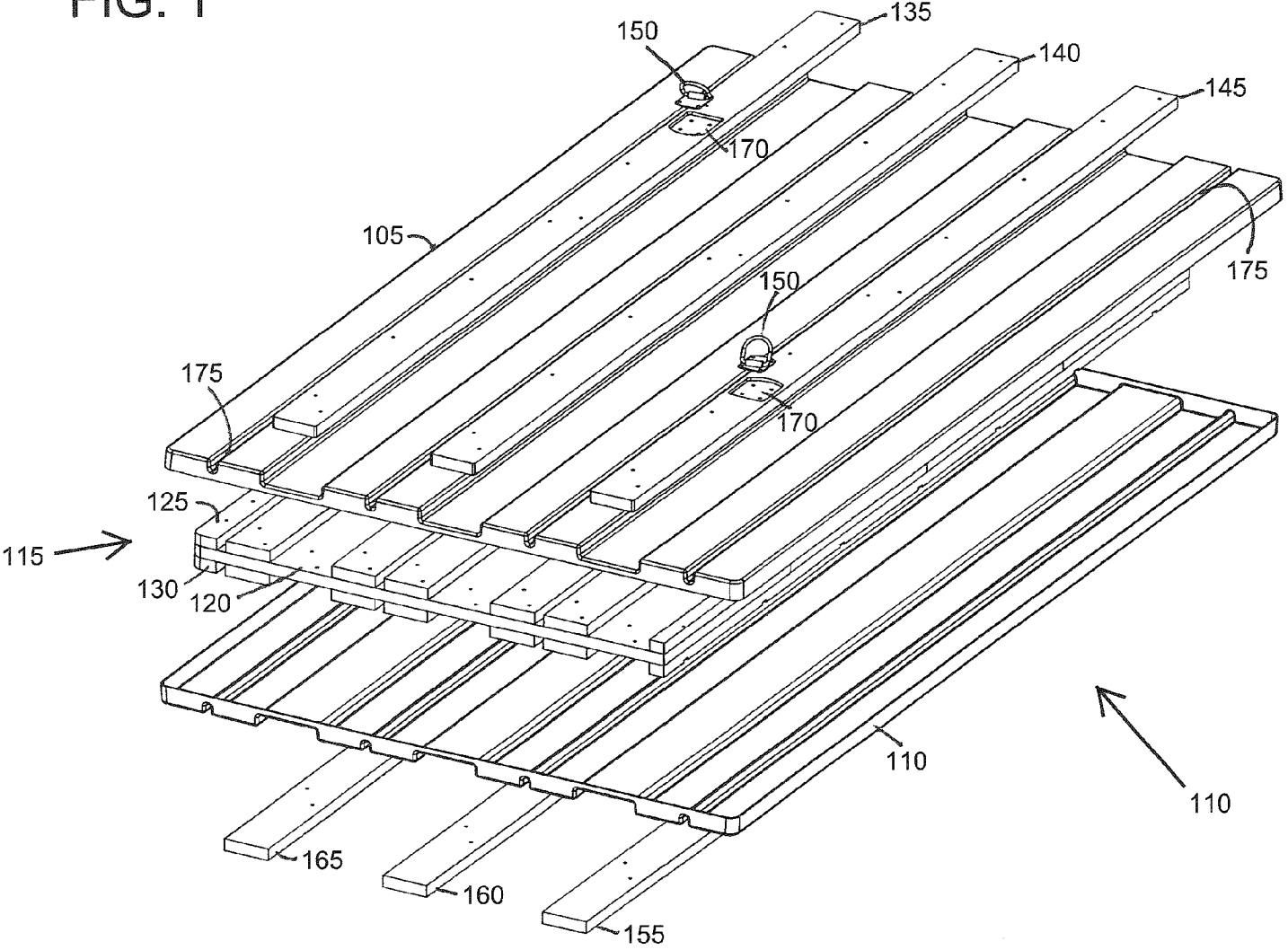
FIG. 1 is an exploded view of the mat of the invention showing the use of single width boards for the upper and lower layers, the skin upper and lower portions and the core construction that is encapsulated by the skin.

The present invention now provides an improved mat that possesses better environmental resistance due to the provision of a skin that surrounds the wood components of the mat or the entire core construction of the mat. The skin is made of an environmentally resistant material. The term "environmentally resistant material" means a material that is not subject to deterioration by water, moisture or other environmental conditions when compared to a conventional wood material such as white oak that is commonly used for such mats. This term includes thermoplastic and thermosetting materials as disclosed herein along with various elastomeric or rubber materials.

Certain terms that are used herein are defined hereinbelow to assist in the understanding of the invention.

The term "industrial mat" is intended to cover relatively large mats having widths of at least about 4 feet with lengths running from about 4 feet to 40 feet and incorporating elongated members, beams or other components having square or rectangular cross sections of sizes of at least about 1×6 to 8×8 inches with lengths from about 4 feet to as much as 40 feet or more. As noted, previous and current mats of this type that are commercially available are primarily constructed of monolithic wood.

The term "substantially" is used for its ordinary meaning to indicate that the dimensions are not precise or exact. A skilled artisan can readily determine what tolerances are acceptable to provide a surface that is considered to be flat based upon the size of the side beams and the type of service that the mat is expected to provide. There is no requirement that the beams and elongated members be flush with each other along the top and bottom surfaces of the mat. Typically, the term "substantially" will mean that the top surfaces of the beams and elongated members can vary by as much as a few inches although in the more preferred embodiments the variance is less than 1 inch.

Additionally, all dimensions recited herein are approximate and can vary by as much as +10% to in some case ±20 or 25%. In some situations, the term "about" is used to indicate this tolerance. And when the term "about" is used before reciting a range, it is understood that the term is applicable to each recited value in the range. Often, the craftsmanship and engineering procedures that are followed in construction of these mats minimize these tolerances as much as possible or industrially practical.

In one embodiment, the present invention provides an improved mat that possesses structural integrity based on the properties and configuration of the core construction as well as abuse and abrasion resistance provided by the encapsulating skin. The skin, also referred to as the encapsulation or encasement, typically includes two pieces, an upper portion and a lower portion, each generally representing half of the encapsulation. The encapsulation will be formed to allow the core construction to be completely accommodated therein, with half of the core being fit within the upper portion and half fit in the lower portion. The tolerance variation for the core construction is ±⅛" and preferably ±1/16" for all dimensions so that it will easily be received within the encapsulation. Once the core is placed inside the encapsulation, the top and bottom portions will be sealed or joined together to completely enclose the core therein.

The encapsulation material is preferably a high density polyethylene made by a manufacturing process known as sheetless thermoforming technology (STF). The resulting mat is preferably an engineered wood product mat encapsulated in a sealed thermoplastic encasement. The primary advantage of this product is preservation of the wood structure contained inside as it is sealed off from the elements prior to experiencing environmental conditions during use at a jobsite.

The encapsulation is preferably a skin made of an environmentally resistant material to protect the core construction from degradation due to weather conditions, typically moisture or water from rain or snow, as well as contact with oil, gas or other chemicals. If the mats are to be used in a particular chemical environment, the skin materials can be selected for resistance against that environment. Generally, however, the skin material is one that can provide water and moisture resistance for the materials that are used for the core construction. Also, the skin material shall be chemically resistant to typical liquids found in the construction site. Thus, the mat will not absorb liquid contaminates so that after cleaning or washing, the mat can be removed from the work site without transporting liquid contaminates.

A wide range of polymeric materials can be used for the skin or encapsulation of the invention. These materials include:

Acrylonitrile butadiene styrene (ABS)
Acrylic (PMA)
Celluloid
Cellulose acetate
Cyclo olefin Copolymer (COC)
Ethylene-Vinyl Acetate (EVA)
Ethylene vinyl alcohol (EVOH)
Fluoroplastics (PTFE, alongside with FEP, PFA, CTFE, ECTFE, ETFE)
Ionomers
Kydex, a trademarked acrylic/PVC alloy
Liquid Crystal Polymer (LCP)
Polyacetal (POM or Acetal)
Polyacrylates (Acrylic)
Polyacrylonitrile (PAN or Acrylonitrile)
Polyamide (PA or Nylon)
Polyamide-imide (PAI)
Polyaryletherketone (PAEK or Ketone)
Polybutadiene (PBD)
Polybutylene (PB)
Polybutylene terephthalate (PBT)
Polycaprolactone (PCI)
Polychlorotrifluoroethylene (PCTFE)
Polyethylene terephthalate (PET)
Polycyclohexylene dimethylene terephthalate (PC (PC)T)
Polycarbonate
Polyhydroxyalkanoates (PHAs)
Polyketone (PK)
Polyethylene (PE)
Polyetheretherketone (PEEK)
Polyetherketoneketone (PEKK)
Polyetherimide (PEI)
Polyethersulfone (PES)—see Polysulfone
Polyethylenechlorinates (PEC)
Polyimide (PI)
Polylactic acid (PLA)
Polymethylpentene (PMP)
Polyphenylene oxide (PPO)
Polyphenylene sulfide (PPS)

Polyphthalamide (PPA)
Polypropylene (PP)
Polystyrene (PS)
Polysulfone (PSU)
Polytrimethylene terephthalate (PTT)
Polyurethane (PU)
Polysulfone (PSU)
Polytrimethylene terephthalate (PTT
Polyvinyl chloride (PVC)
Polyvinylidene chloride (PVDC)
Styrene-acrylonitrile (SAN)

The preferred materials are those that are moldable to form the upper and lower portions of the skin, as well as those that are weldable or otherwise capable of being adhered, sealed or otherwise merged together so that the core construction can be fully encapsulated and sealed from environmental conditions.

The skin is molded into upper and lower portions, which are preferably identical. These portions are configured to be placed upon the upper and lower layers of the core construction. To facilitate placement of the upper and lower portions on the core construction, the components used for constructing the core are made of engineered lumber or processed white oak in order to provide close tolerances of around $\pm 1/8^{th}$ of an inch or less and typically around $1/16^{th}$ of an inch. This assures that the upper and lower portions of the skin will fit properly and snugly on the core construction with the peripheries of the upper and lower portions in contact so that they can be joined together by welding, adhesives, additional molding or other techniques that join and seal the portions together. This assures the complete encapsulation of the construction core in order to prevent egress of water, moisture, chemicals or other solutions that will over time cause degradation of the wood materials.

Alternatively, the skin can be provided in other ways, including but not limited to immersion coating of the entire core construction or by painting or otherwise depositing skin material to completely encapsulate the core construction. The skin material is typically a thermoplastic polymer, a thermosetting resin or an elastomeric material. For example, the entire core construction can be coated with a thermosetting resin to form a solid unitary mat structure.

As mats are generally designed with water channels on the upper surface or layer to drain water from the mat, the skin must also be configured with the same design to achieve that purpose. Accordingly, the upper surface of the upper portion is not flat but is instead configured to match the boards of the mat. Alternatively, when the core construction provides a flat upper surface, the upper portion of the skin can be provided with water channels or other non-flat surfaces. In fact, the upper portion of the skin can be configured to provide molded material in place of the upper layer of elongated members of the core construction. The same can be done for the lower layer.

The core construction housed within the encapsulation comprises two or three layers: a central layer for strength and rigidity; and a layer of elongated members positioned above or below the central layer. Preferably, three layers are present. Suitable materials for the components of the upper, center and/or lower layers of the core construction include any of the materials mentioned in this application. Wood and preferably Engineered wood is the most preferred due to the balance of a cost and desirable properties, but in addition, metal, thermoplastic and thermosetting materials, and elastomeric materials may be used. The elastomers are usually thermosets (requiring vulcanization) but may also be thermoplastic. Typical elastomers include:

Unsaturated rubbers that can be cured by sulfur vulcanization—these are preferred from a strength and hardness standpoint:

Natural polyisoprene: cis-1,4-polyisoprene natural rubber and trans-1,4-polyisoprene gutta-percha;
Synthetic polyisoprene;
Polybutadiene;
Chloropene rubber, i.e., polychloroprene;
Butyl rubber (i.e., copolymer of isobutylene and isoprene) including halogenated butyl rubbers (chloro butyl rubber; bromo butyl rubber);
Styrene-butadiene Rubber (copolymer of styrene and butadiene); and
Nitrile rubber (copolymer of butadiene and acrylonitrile).

Saturated (non-vulcanizable) rubbers include:

Ethylene propylene rubber (EPM);
Ethylene propylene diene rubber (EPDM);
Epichlorohydrin rubber;
Polyacrylic rubber;
Silicone rubber;
Fluorosilicone Rubber;
Fluoroelastomers;
Perfluoroelastomers;
Polyether block amides; and
Chlorosulfonated polyethylene.

The elastomeric and thermoplastic materials disclosed herein can also be provided with conventional filler materials to increase weight and hardness. They also can be reinforced with fiberglass, other fibers, fabric or metal sheets, screening or scrim to reduce elongation and provide greater rigidity.

Another type of rubber material is crumb rubber which is prepared by grinding worn or discarded rubber vehicle tires. This material can be mixed with a thermoplastic or thermosetting material and set or cured in place to form the skin around the mat or individual wood boards.

Preferred materials for the central layer include:

various thermosetting materials, including Epoxy, Melamine formaldehyde (MF), Phenol-formaldehyde (PF), Polyester, Polyurethane (PU), Polyurea, Polyimide (PI), Silicone (SI) or Urea formaldehyde (UF). These materials can be reinforced with fibers or filler (carbon, glass, metal, etc.);

a thermoplastic material (any of the various plastics mentioned hereinabove) and in particular, HDPE, PET and SBR as disclosed in U.S. Pat. No. 6,380,309;

a honeycomb structure with filled cells and upper and lower plate surfaces that are molded or otherwise constructed, as disclosed in U.S. Pat. No. 8,061,929;

open face filled cellular structures of thermoplastics, polyolefins or vulcanized rubber as disclosed in U.S. Pat. No. 6,511,257;

molded sheets of thermoplastic resin as disclosed in U.S. Pat. No. 5,888,612; or a reinforced plastic composite material as disclosed in U.S. Pat. No. 4,629,358.

The edges of the core construction can be protected as disclosed in US patent 2014/0193196 or with wood or synthetic laminate to avoid mechanical damage to core edges. In the present invention, elastomeric materials can also be used.

For certain open cell core construction materials, reinforcement with wood, metal or plastic, the cells can be filled with other materials to provide the desired weight to the mat. Also, reinforcements of fabrics, sheets or other cell closing materials can be used to improve stiffness and strength of the layer and if necessary to retain the filler in the cells or openings in the construction core material.

It is also possible to use a metal plate or open metal structure as the center layer, either alone or with upper and/or lower sheeting or even as a reinforcement of a thermoplastic, thermosetting or elastomeric pad. Thus, the central layer can include multiple components that are assembled together to form the structure to which the upper and lower elongated members or boards are attached.

When metal central layers are used, the metal structures may include metal lath or metal sheet or structures that include cells or openings therein to reduce the overall weight of the mat. Steel, aluminum or stainless steel are typical metals for this use. To reduce the weight of the mat when the construction core it is made of metal, a honeycomb or lath structure is used, or the construction core is provided with a plurality of openings. For very open structures, the cells or openings can be filled as noted above with a material that is lighter than the metal to maintain the weight at a desired level. The openings can be covered with upper and/or lower sheeting to retain the filler therein. Any material can be used for the sheeting as the metal core is providing the necessary strength and rigidity to the mat. Typically, the sheeting may be plywood, plastic, metal or composite material, and can be solid or in mesh form. The sheeting can be attached to the mat by bolting or by an adhesive. The sheeting and core can be maintained in position be being sandwiched between the outer layers, with the entire structure held together by bolting. If necessary, holes for the bolts can be drilled through the metal plate or sheeting to facilitate assembly by allowing passage of the bolts therethrough.

Preferably, the upper, central and lower layers are nailed and/or bolted together to form the core construction. For a core construction where the interlocking boards (boards 3, 6 and 9 of the single width construction and the three 6" boards of the double width construction) are not included, these may be provided on top of the skin. They can be bolted or nailed onto the core construction through the skin, but with appropriate sealing of the skin with additional material to prevent water or chemical penetration into the core construction. This arrangement provides two additional benefits. First of all, the boards placed outside of the skin are easily replaceable if damaged while the protected core remains intact. Also, this arrangement facilitates the placement of lifting elements included in boards 3 and 9 of the single width construction or in the first and third 6" boards of the double width construction.

The most preferred construction includes three layers of engineered lumber. Engineered lumber, also known as composite wood, man-made wood, or manufactured board; includes a range of derivative wood products which are manufactured by binding or fixing strands, particles, fibers, or veneers or boards of wood, together with adhesives, or other methods of fixation to form the composite material known as engineered lumber. These products are engineered to precise design specifications and tolerances which are much more controlled than ordinary wood products and meet various national or international standards and these controlled dimensions are carried over into the construction of the mat. Typically, engineered wood products are made from the same hardwoods and softwoods used to manufacture lumber.

There are three types of engineered wood that can be used in the present invention:

parallel strand laminate (PSL), which is a beam that can be manufactured up to about 12×12 inches in any length due to the production of the beam by a continuous process;

layered stand laminate (LSL), which is a billet that can be made at thicknesses of from about 1" to 4", in widths from about 2 inches to 54", and in lengths of about 8 feet to 64 feet; and layered veneer laminate (LVL) which is also a billet that can be made up to about 4 feet square by any length.

The preferred types of engineered lumber are laminated strand lumber (LSL) layered veneer laminate (LVL). The thickness of these lumber beams will be what is called 2×8 inches, which is actually approximately 1.75 inches thick but may be between 1.5 and 3 inches. Length can be as desired but will preferably be 12, 14 or 16 feet. The width of the LSL or LVL boards will vary depending upon location within the three layer mat. That is, width of the top and bottom layer boards will be approximately 8 inches (single width) or 16 inches (double width). Approximately means they may be slightly less such as 7.5 to 8.5 inches or 15 to 17 inches. Of course, as the LSL or LVL is manufactured, any particular thickness, width and length can be selected, but the preferred dimensions disclosed herein approximate those of conventional white oak mats which are in extensive use in the industry. A typical thickness for the mat is approximately 6" to 8", with the central layer providing a thickness of about 1" to 6" and preferably 2 to 4" and the upper and lower layers providing a thickness of about 1" to 3". Of course, the dimensions can vary depending upon the specific end use intended for the mat.

The center layer will be approximately 4 to 8 feet by 12, 14 or 16 feet. The center layer may be made of LSL, LVL or other boards that are oriented perpendicularly to the boards of the top and bottom layers. The number of top, bottom, and center boards will be dictated by the final dimensions of the mat for the particular application or end use. When the center layer is a sheet or plate, the boards of the upper and lower layers can be oriented in the same or a different direction. Generally, for manufacturing simplicity, the boards of these layers are oriented to be parallel or perpendicular to each other. Other more complex angled board arrangements may also be used without departing from the teachings of this invention.

In a most preferred embodiment, the mat includes a core construction comprising a central layer, an upper layer positioned above the central layer and a lower layer positioned below the central layer, wherein each layer includes a plurality of elongated members of wood or engineered wood having thickness and width dimensions of approximately 2" by 8", and with each having a modulus of 1.6 M psi±20% up to about 2 M psi±20% and with the elongated members of the upper and lower layers oriented parallel or perpendicular to each other. Also, the core construction is made of materials that provide a load bearing capacity that is able to withstand a load of at least 600 to 800 psi without damaging or permanently deforming the core construction.

The core construction can include one, two or three layers as desired or necessary for a particular installation. The most preferred construction includes three layers as noted herein.

When elongated members are used for the upper and/or lower layers of the core construction, they provide additional weight to the mat and can be configured in different ways:

a single width construction may be used where eleven 6" wide (by 12' 14' or 16' long) boards are provided in the upper and lower layers with three boards (nos. 3, 6, and 9) in the lower layer offset for interlocking; or a double width construction may be used where four 12" wide (by 12 or 16' long) boards are provided in the upper and lower layers: each one separated by a 6" board with the three 6" boards in the lower layer offset to provide interlocking The boards can be made of wood or engineered lumber (preferably with a tolerance of ±1/16") or they can be made of tubes of metal of a thermoplastic or thermosetting material, with pultruded thermosetting tube being one example of a preferred alternative material.

The core constructions may include those made of white oak as disclosed in U.S. Pat. No. 4,462,712 (three layer) and U.S. Pat. No. 5,822,944 (two layer), the entire content of each of which is expressly incorporated herein by reference thereto. Additional processing of the wood will ordinary be required to achieve the desired tolerances for optimum fitting of the construction core in the encapsulation pieces.

An alternative embodiment relates to the provision of a skin or coating of one or more of the environmentally resistant materials disclosed herein around a sheet, beam or board mat component of wood or engineered wood. The skin or coating is applied prior to the assembly or incorporation of the component into the mat. The skin or coating is applied to all exposed surfaces of the component so that moisture cannot get into the wood and eventually cause deterioration or rotting. The thicknesses would be the same as in other embodiments, namely, 0.25 to 0.5".

Referring now to the Figures, FIG. 1 illustrates mat 100 that includes an upper skin 105 and lower skin 110 which are used to surround and encapsulate core construction 115. The core construction includes a rectangular sheet 120 of wood, plywood, or non-wood material. On the top surface of sheet 120, boards 125 are applied to the sheet 120 by nailing, screwing, bolting or combinations thereof. On the bottom surface of sheet 120, boards 130 are also applied by nailing, screwing or bolting of boards 130 to the sheet 120. Preferably LSL boards are used for the upper and lower boards to obtain a good balance of dimensional tolerance, cost and performance.

When bolting is used, the bolts can extend from the upper boards 125 to the lower boards 130 through the sheet 120. The nails, screws or bolt heads and nuts are recessed below the top surface of boards 125 and below the bottom surface of boards 130 to present relatively smooth upper and lower surfaces of the core construction 115.

Alternatively, the boards can be attached to the sheet 120 by an adhesive or other means that provide a secure attachment. For example, when the core construction is made of a thermosetting material, the sheet and boards can be made of the same material in a unitary component. The same is true of a welded metal core construction.

As shown in FIG. 1, eight (8) boards are used, with each two board pair separated by a space that would accommodate another board. Both the upper and lower boards that are attached to the sheet 120 are arranged in the same way so that the same size skin portions can be used to encapsulate the top and bottom of the core, thus allowing a single mold to provide moldings that can be used as either the upper or lower skin portions.

Spaces are provided for the third, sixth, and ninth boards (135, 140, 145, respectively) of the upper portion of the mat to allow such boards to be applied to the skin portions after encapsulation of the core construction 115. Also, space is provided for the third sixth and ninth boards (155, 160, 165, respectively) of the lower portion of the mat to allow interlocking of the mat to an adjacent mat. The boards 155, 160 and 165 are applied to the lower skin portion in order to extend outwardly from the end of the mat to be received in a space in the lower skin of an adjacent mat. Although these additional boards are attached to the mat by screwing or bolting, any holes made through the skin are also sealed to prevent introduction of water or moisture into the core construction.

Lifting elements 150 are provided on the third and ninth boards of the upper skin portion. These lifting elements 150 are configured as D shaped rings which are attached to the boards in recesses 170 so that the lifting element 150 can remain flat when the mat 100 is in use. Two lifting elements are shown but a skilled artisan can determine how many elements are needed for lifting of any particularly sized mat. If desired, lifting elements can also be provided on the boards attached to the lower skin portion 110 for versatility in the handling and transportation of the mat. The lifting elements are provided on the boards that are attached to the skin portion so that if the lifting elements or boards are damaged they can be easily removed and replaced.

The provision of single width boards enables the upper and lower moldings to have water channels 175 on the upper surface of the skin to drain water from the mat.

Figure 2:
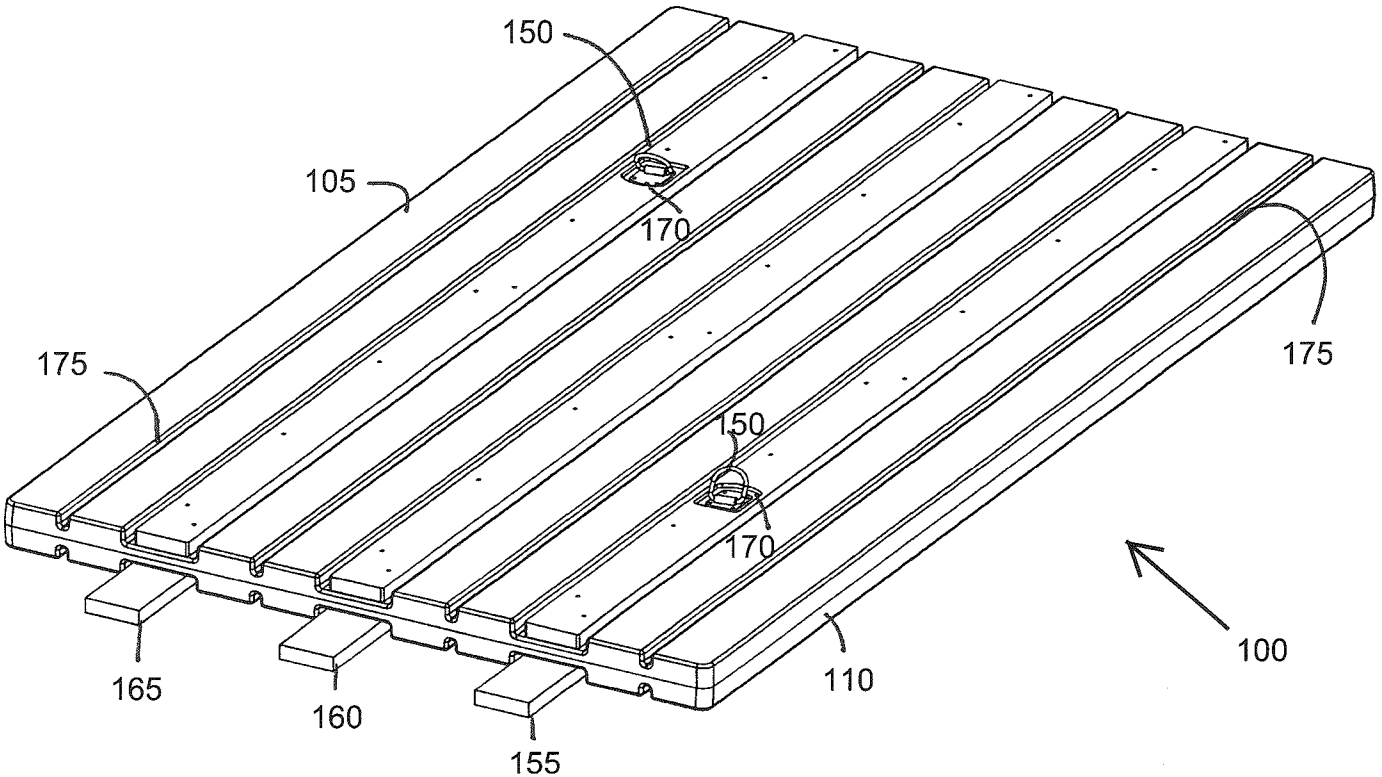
FIG. 2 is a view of the assembled mat of FIG. 1.

FIG. 2 illustrates the final shape and configuration of the mat 100 after assembly.

Figure 3:
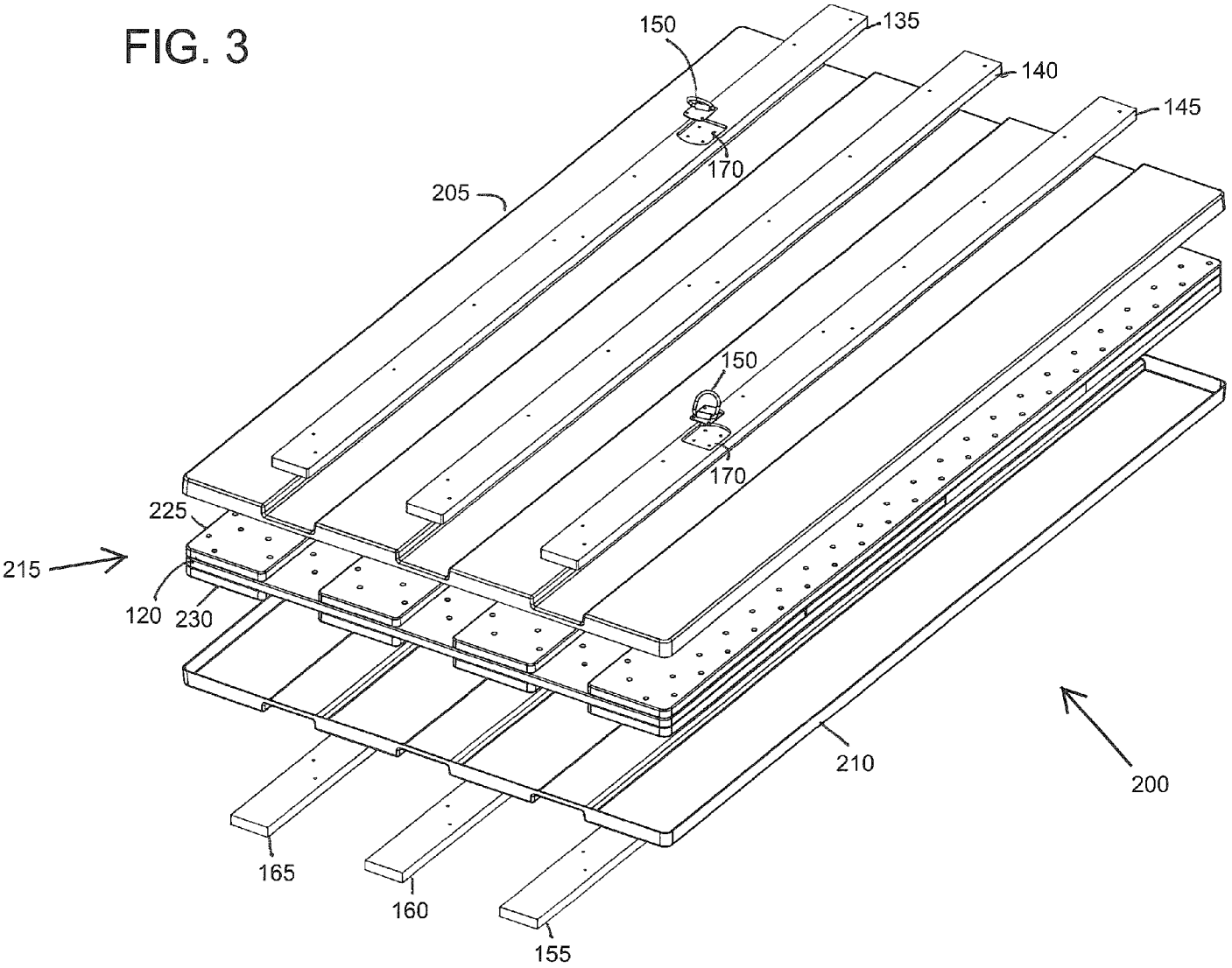
FIG. 3 is an exploded view of a mat according to the invention showing the use of double width boards for the upper and lower layers, the skin upper and lower portions and the core construction that is encapsulated by the skin.

FIG. 3 illustrates a second mat 200 according to the invention. In this mat, double width boards 225, 230 are used in place of the single width boards 125, 130 of FIG. 1. This results in upper 205 and lower 210 skin portions that have a wider molded segments to accommodate the double width boards. As in the embodiment for FIG. 1, space is provided for the additional boards that include the lifting elements and that provide interlocking. As a number of the same components are used, the same numerals used in FIG. 1 are used to designate the same components for the mat of FIG. 3.

Figure 4:
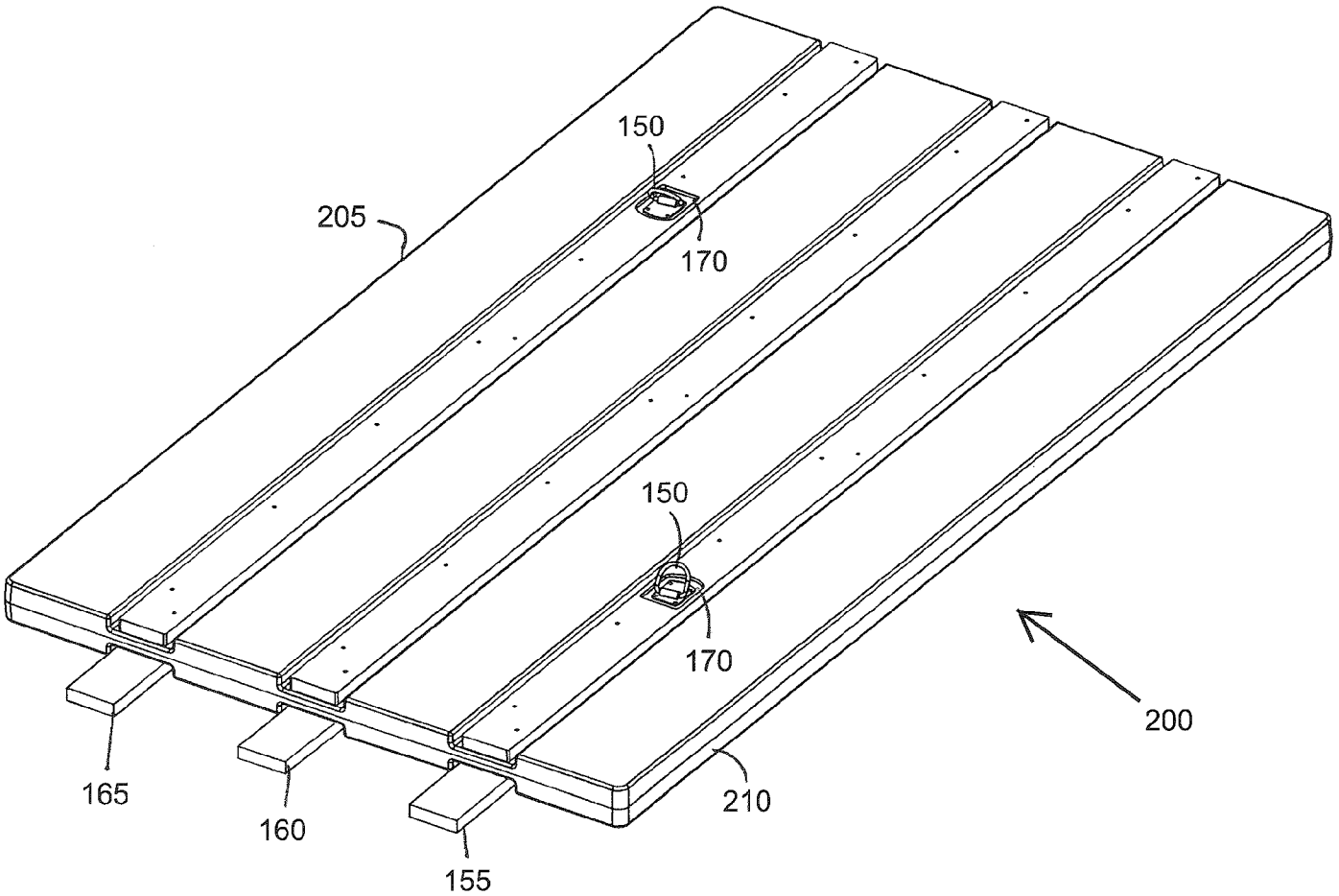
FIG. 4 is a view of the assembled mat of FIG. 3.

FIG. 4 illustrates the final mat 200 after assembly.

The drainage channels 175 provide an advantage for mat 100 compared to mat 200 when the mats are to be used in an environment that will experience rainy or snowy weather conditions. For application of the mats in a dry environment, mat 200 is preferred because it is easier to manufacture.

In an alternative embodiment, each board of the various layers of the mat are encapsulated with the skin or a coating of one or more of the various materials mentioned herein. The skin can be provided in other ways, including but not limited to immersion coating of each board or by painting or otherwise depositing skin material to completely encapsulate the boards. Combinations of these techniques can be used as well, wherein a sheet or layer of the material is initially applied to the boards. Thereafter, the ends of the boards can be sealed with coating material and the overlapping edges of the sheet or layer sealed with an adhesive. Polymer sleeves can also be used with the ends of the sleeved folded upon the ends of the boards. Thus, each board will be protected from moisture as well as from abrasion due to traffic or equipment that passes over or is placed upon the mat. The outermost layers experience the greatest traffic and for that reason may be further provided with an additional surface coating of a material that provides additional abrasion resistance or with particles of various materials such as inorganic, rubber or plastic material to provide a non-slip surface. Crumb rubber can be used for this purpose. For environmental benefits, the crumb rubber can be obtained by grinding used automobile tires into the desired particulate size.

The provision of a skin on the boards of the central layer protects that layer from moisture which would cause rotting or deterioration of the boards. This also enables the central layer to be reused if the boards of the outer layers require replacement.

When assembling the encapsulated boards into the mat, care should be used to close off any holes made for bolts or other attachment means. Bolts can be made of stainless steel or aluminum to prevent rusting while the holes through which they pass can be sealed off with a rubber gasket or o-ring placed beneath the bolt heads or nuts to make it more difficult for moisture to enter into the wood through the bolt holes.

And while offsetting of certain boards is shown for providing an interlocking with adjacent mats, this is not always needed such that interlocking can be considered to be an optional yet desirable feature. Interlocking is often preferred to avoid staking of the mats to the ground or to avoid including other more complex components for use in connecting adjacent mats together.

Another feature of the invention is the use of color coding to identify the core construction of the mat. As the encapsulation is opaque, it is not possible to visually determine how the core is made. Thus, a color coding system can be used to identify the specific core construction. This can also be used to identify mats for a particular customer or end user. When mats are rented or leased, the color coding can be used to identify which mats belong to the leasing company compared to mats provided by others. The color coding can be of a single color or of certain stripes, patterns, dots or other indicia that provides a "signature" that identifies the specific core that is present in the mat or a particular end user or owner of the mat.

All of the mats according to the invention are to be installed on a prepared ground surface so that they will perform acceptably. Ground preparation is typically upon a material of uniform flatness (e.g., within +/−12" over an 8'×14' surface). Crushed stone or rock generally no larger than 4" diameter is acceptable for preparing the ground as a substrate for supporting the mats.

All mats according to the invention that include the most preferred core construction or alternatives thereof are designed to meet the following product specifications for preferred implementations as temporary roadways, equipment support surfaces, platforms and similar applications. A further benefit of the mats of the invention is that they do not cause contamination of the ground surfaces upon which they are applied.

Preferred overall mat dimensions are approximately 8' wide×6" tall and are either 12 ft, 14 ft or 16 ft in length. The interlocking feature will extend the length of the mats by about 1 ft at three locations at one end of mat. U.S. Pat. No. 4,462,712 discloses mats which contain interlocking fingers and recesses which are preferred for use in the present invention.

The mats typically include three (3) layers of individual wood or composite boards, having cross section dimensions of 1.75" by 8".

The spacing between individual boards or components in the upper layer is preferably approximately 1.25" to allow water to drain from the mat. This spacing is retained in the upper portion of the skin. The slip resistance of the mat is improved by the draining of the excess water, especially when use in locations that experience heavy rain or snow conditions.

The preferred mats have physical properties that meet or exceed the physical properties of a conventional white oak mat.

The mat must also provide sufficient load bearing capacity: a fully supported mat (one that is properly installed on an approved ground surface preparation) must withstand a 10 ton load, spread over a 12" diameter surface without degradation of mat properties or permanent deformation of core construction of the mat. The core would have a crush resistance of between about 600 and 800 psi depending upon the application. This provides resistance against compression while not detracting from providing resistance to torsion forces that applied to the mat by vehicles passing thereover.

Optionally and preferably, the perimeter edges of the mat are provided with additional protection to prevent or reduce damage to the core construction of the mat from side entrance or egress onto the mat from large vehicles with steel tracks. The edge material helps protect the core construction and may be removable. The edge material may be made of wood, metal, or a plastic or elastomeric material.

Preferably, the skin is relatively inflammable. Flammability of mat is defined as Class 2 (B) flame spread when measured by ASTM E84 test criteria. The flammability properties of the skin materials can be enhanced by adding the appropriate conventional flame retardant or other additives that are known to impart such properties.

The skin should also allow dissipation of static electricity. For this purpose, the skin can include carbon black, metal particles or other conductive fillers.

To prevent premature deterioration of the skin, the material for the skin should contain UV inhibitors as necessary and in an amount sufficient to reduce deterioration of physical properties or color.

To assist in gripping of vehicle or personnel traffic on the mat, a non-slip or textured surface can be applied to the exposed surface of the upper portion of the skin. This can be sand or other grit material that is embedded in the skin during preparation or molding or that is later added with an adhesive or a coating.

For ease in moving of the mats, attachment points can be provided that allow for lifting and handling of individual mats. Lifting hardware preferably includes D rings, O-rings, chain, or cables at 2-4 locations on the upper surface of the mat. The exact position and attachment of lifting hardware is designed based on the size and weight of the mat and is intended to avoid damage to the encapsulating skins or the internal structure of the mat.

The core construction of the mat preferably is not hollow. If hollow components are used for the various layers of the core construction, such as metal lath, metal sheets with openings provided therein, thermoplastic or fiberglass reinforced thermosetting plastic structures with open cells, or the like, the cells or openings may be preferably filled with a non-absorbent material. A wide variety of different plastic, elastomeric or foam materials can be used for this purpose. The hollow portions can be used as is or can be provided with filler or other materials to increase or decrease weight as needed. Fillers of glass, ceramic or metal particles can be included to provide additional weight or strength to the mat. Other materials such as recycled rubber tire material or other environmentally friendly materials can instead be used. Preferably, the mat has a weight that is on the order of a white oak mat of similar size.

For a more advanced product, the core construction layer may be made of environmentally resistant material to further prevent against degradation due to weather conditions in the event that the skin becomes damaged or otherwise compromised to allow liquid to enter into the core construction.

The term "environmentally resistant material" means a material that is not subject to deterioration by water, moisture or other environmental conditions when compared to a conventional wood material such as white oak that is commonly used for such mats. This term includes thermoplastic and thermosetting materials as disclosed herein along with elastomers and even metals such as steel, aluminum or stainless steel. While steel does rust when encountering moisture or water, this is not considered to be a deterioration of the material as it is a surface phenomenon that does not affect the physical properties of the material but instead just detracts from its surface appearance. To avoid this, the steel components can be coated or painted to provide a better appearance and even further environmental resistance. Under certain conditions treated wood can withstand rotting and degradation much better than untreated wood such that it would be considered to be an environmentally resistant material because of it improved resistance against rotting.

A number of additional features may be provided in the mats of the present invention. A radio frequency identification (RFID) tag can be embedded into the access mats in a routered pocket in the core construction to enable the access mats to be monitored in an inventory system or when rented for use. The tag provides a unique identification serial number for each mat, such that the mats which are being used or rented can be tracked and accounted for as to location of use. The mats can be scanned when in a warehouse, when loaded on trucks for delivery, when delivered to a job site, or when collected from a jobsite after use. The RFID tags can be active or passive and if desired, other tracking devices such as barcodes could similarly be for the same purposes. It is preferred, however, that the RFID tag be embedded in the mat so that it is protected from damage by the skin that encapsulates the mat. When a barcode or other surface mounted tag or indicia is used, it should be placed on a surface portion of the mat that is less likely to experience wear or abuse. Thus, the tag may preferably be applied onto the side of the mat so that it is not directed exposed to traffic on the mat.

In order to manipulate the mats for loading/unloading, or moving from one location to another or for installation and retrieval, the mats can include a retractable lifting element. This can be the lifting elements described above and those elements lie in a recess in the top surface of the mat during use for ease of access and to prevent tripping or damage to items moving over the mat or damage to the lifting elements themselves. Alternatively, a more complicated design such as that of US patent publication 2008/0292397 can be used.

To assist in the use of the mat during the night or on days that are dark due to poor weather conditions, the mat may include one or more lighting elements, such as those disclosed in International application WO 2006/048654. These lighting elements would preferably be embedded in the skin. The skin can be provided of clear plastic, so that the lighting element may be positioned below the skin for better protection of the lighting element during use. As the embedding of the lighting element below the skin surface can result in reduced luminosity, a skilled artisan can best determine the appropriate location for the placement of the lighting element in or under the skin and for providing the skin of the appropriate color or clarity to achieve the desired lighting brightness. This can also be adjusted by providing a larger number of lighting elements or of lighting elements of larger size.

The present invention provides unexpected benefits over the art in that the skin provides resistance to abrasion and abuse of the core construction while also preventing moisture, water or chemicals from the surrounding environment from penetrating into the core construction. Additionally, the mats have anti-static properties and provide traction and anti-skid surfaces depending upon the finish of the skin or coating surfaces that are exposed. These can be provided with particulate matter of any type of inorganic particles or plastic or rubber pellets to provide an anti-skid surface. The amount of particles would depend upon the size and can be determined by routine testing depending upon the material use for the skin or coating. Also, certain materials such as rubber, when present as or in the skin, act as a heat sink to allow ice to melt more quickly from the mat which is a safety feature when the mats experience snow and ice conditions in winter. The mats can also be pigmented to be place to assist in absorbing sunlight to melt ice or snow.

All of these features contribute to the ability of the mat to provide a much longer service life compared to when wood components are used alone since the skin prevents rotting or other chemical degradation of the wood components of the core construction. Further enhancements in service life can be expected by providing a core construction made of thermosetting or thermoplastic materials or plastic coated metal. Finally, when the service life of the skin is being approached, the skin can be cut off or otherwise removed from the core so that a new skin can be applied. Alternatively, when single boards are encapsulated, only those where the coating or skin is damaged need replacement. To the extent that any of the components of the upper or lower layers are damaged, they can be replaced so that a new mat can be made with the reuse of a substantial part of the core construction. In some situations, such as where the core construction remains in relatively good condition from, e.g., the use of non-wood core components, only a portion of the skin can be removed and replaced, thus providing further savings in recycling rather than replacing the mat.

What is claimed is:

1. An industrial mat comprising:

a core construction that provides strength and rigidity to the mat, the core construction including plural layers or plies of components that are nailed or bolted together to form a rigid core construction, wherein at least some or all of the components are wood or engineered wood; and an encapsulation of a durable skin of a thermoplastic, thermosetting or elastomeric material or a mixture thereof that surrounds and fully encapsulates at least each of the wood components, with the skin having a thickness sufficient to provide environmental resistance to the wood components or core construction that it encapsulates, while also providing abrasion resistance to the mat.

2. The mat of claim 1 wherein the core construction comprises a central layer made of a sheet, a plurality of elongated members, a plurality of compartments, or combinations thereof.

3. The mat of claim 2 wherein the core construction includes an upper layer positioned above the central layer wherein the upper layer is made of a sheet, a plurality of elongated members or combinations thereof.

4. The mat of claim 3 wherein the core construction includes a lower layer positioned below the central layer wherein the lower layer is made of a sheet, a plurality of elongated members, a plurality of compartments, or combinations thereof.

5. The mat of claim 3 wherein the central and upper layers each comprises a plurality of wood or engineered wood boards having a modulus of at least about 1.6 M psi.

6. The mat of claim 4 wherein the central and lower layers each comprises a plurality of wood or engineered wood boards having a modulus of at least about 1.6 M psi.

7. The mat of claim 1 wherein the core construction is made of materials that provide a load bearing capacity that is able to withstand a load of at least 600 to 800 psi without permanently deforming the core construction.

8. The mat of claim 1 wherein the skin has a thickness of 0.25 to 0.5 inches.

9. The mat of claim 8, wherein the skin comprises a mixture of an elastomeric material and a thermoplastic or thermosetting resin.

10. The mat of claim 9 wherein the skin comprises high density polyethylene or an elastomeric material, and wherein the core construction comprises plural layers that include elongated members of wood.

11. The mat of claim 10 wherein the core construction includes a central layer, an upper layer positioned above the central layer or a lower layer positioned below the central layer or both upper and lower layers, wherein each layer includes a plurality of elongated members of wood or engineered wood, each having a modulus of at least about 1.6 M psi, and wherein the core construction is made of materials that provide a load bearing capacity that is able to withstand a load of at least 600 to 800 psi without permanently deforming the core construction.

12. An industrial mat comprising:

a core construction that provides strength and rigidity to the mat, the core construction including plural layers or plies of elongated wood or engineered wood members that are nailed or bolted together to form a rigid core construction; and an encapsulation of a durable skin of a thermoplastic, thermosetting or elastomeric material or a mixture thereof that surrounds and fully encapsulates each of the elongated wood or elongated wood members of each layer, the skin having a thickness sufficient to provide environmental resistance to each of the elongated wood or engineered wood members that it encapsulates, while also providing abrasion resistance to the mat.

13. The mat of claim 12 wherein the skin has a thickness of 0.25 to 0.5 inches.

14. The mat of claim 12 wherein the core construction comprises a central layer and an upper layer; a central layer and a lower layer, or a central layer, upper layer and lower layer, all wood components of the mat are encapsulated with the skin, and the skin comprises high density polyethylene, an elastomeric material, or a mixture of an elastomeric material and a thermoplastic or thermosetting resin.

15. The mat of claim 14 wherein the layers of the core construction each include a plurality of wood or elongated wood boards having a modulus of at least about 1.6 M psi±20%, and the mat is able to withstand a load of at least 600 to 800 psi without permanently deforming the core construction.

16. The mat of claim 12 wherein the elongated wood members are attached to the mat with bolts and the bolt heads and nuts are provided with o-rings or gaskets to prevent moisture from entering into bolt holes in the elongated wood or elongated wood members.

17. The mat of claim 11 wherein the skin has a thickness of 0.25 to 0.5 inches.

* * * * *